US005193368A

United States Patent [19]

Ling

[11] Patent Number: 5,193,368

[45] Date of Patent: Mar. 16, 1993

[54] COMBINATION LOCK OF STRAP BUCKLE

[76] Inventor: Chong-Kuan Ling, c/o Sinox Co., Ltd., P.O. Box 96-156, Taipei, Taiwan

[21] Appl. No.: 896,654

[22] Filed: Jun. 10, 1992

[51] Int. Cl.[5] ..... E05B 37/02

[52] U.S. Cl. ..... 70/30; 70/57; 70/312; 70/326; 70/328

[58] Field of Search ..... 70/18, 30, 57, 58, 3-5, 70/69-72, 74-76, 312, 316-318, 326, 328

[56] References Cited

U.S. PATENT DOCUMENTS

| | | | |
|---|---|---|---|
| 3,820,363 | 6/1974 | Bako et al. | 70/312 |
| 4,100,775 | 7/1978 | Bako | 70/3 |
| 4,610,152 | 9/1986 | Düringer | 70/30 |
| 4,912,950 | 4/1990 | Crowle | 70/58 |

FOREIGN PATENT DOCUMENTS

| | | | |
|---|---|---|---|
| 1933381 | 1/1971 | Fed. Rep. of Germany | 70/30 |
| 2725843 | 12/1977 | Fed. Rep. of Germany | 70/18 |
| 624266 | 8/1961 | Italy | 70/75 |
| 2133830 | 8/1984 | United Kingdom | 70/69 |

*Primary Examiner*—Lloyd A. Gall

[57] ABSTRACT

A combination lock of strap buckle includes a female lock body secured on a first end portion of a strap or belt; a male buckle secured on a second end portion of the strap engageable with the female lock body for fastening the two end portions of the strap; and a plurality of sleeves coupled with a plurality of dials, having a plurality of numerals annularly formed on each dial, rotatably mounted in the female lock body for operatively locking the male buckle in the female lock body, whereby upon a rotation of the dials from a locking combination to an unlocking combination, the male buckle will be unbuckled from the female lock body for an unlocking operation, thereby providing a combination lock for the strap buckle by omitting a key and a key-actuated safety lock for increasing locking or unlocking convenience of the strap buckle.

4 Claims, 5 Drawing Sheets

COMBINATION LOCK OF STRAP BUCKLE

BACKGROUND OF THE INVENTION

U.S. Pat. No. 4,674,303 to Paul J. Salcone discloses a safety lock for seat belt buckle providing a locking portion (28) on the housing portion which however should require a key for unlocking the lock. To hold such a key for an instant unlocking use may cause inconvenience for the user. If the key is missing, it will become a difficulty to release the seat belt buckle.

U.S. Pat. Nos. 4,685,315 and 4,691,539 respectively teach a strap lock and band lock, which however requires a key for unlocking the lock, possibly causing inconvenience to the lock user and causing embarrassment when losing the key especially when travelling or sporting outside the user's home.

SUMMARY OF THE INVENTION

The object of the present invention is to provide a combination lock of strap buckle including a female lock body secured on a first end portion of a strap or belt; a male buckle secured on a second end portion of the strap engageable with the female lock body for fastening the two end portions of the strap; and a plurality of sleeves coupled with a plurality of dials, having a plurality of numerals annularly formed on each dial, rotatably mounted in the female lock body for operatively locking the male buckle in the female lock body, whereby upon a rotation of the dials from a locking combination to an unlocking combination, the male buckle will be unbuckled from the female lock body for an unlocking operation, thereby providing a combination lock for the strap buckle by omitting a key and a key-actuated safety lock for increasing locking or unlocking convenience of the strap buckle.

DETAILED DESCRIPTION

Figure 2:
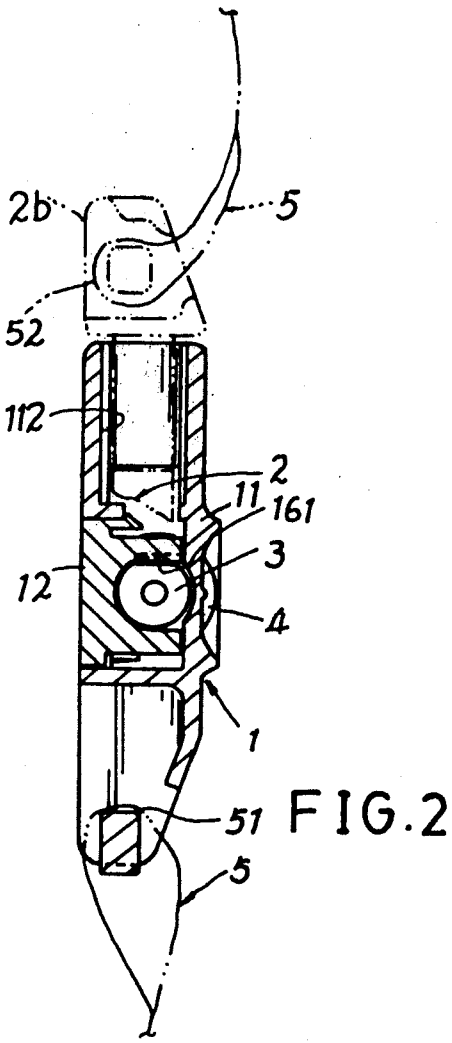
FIG. 2 is a side-view sectional drawing of the present invention.
Figure 1:
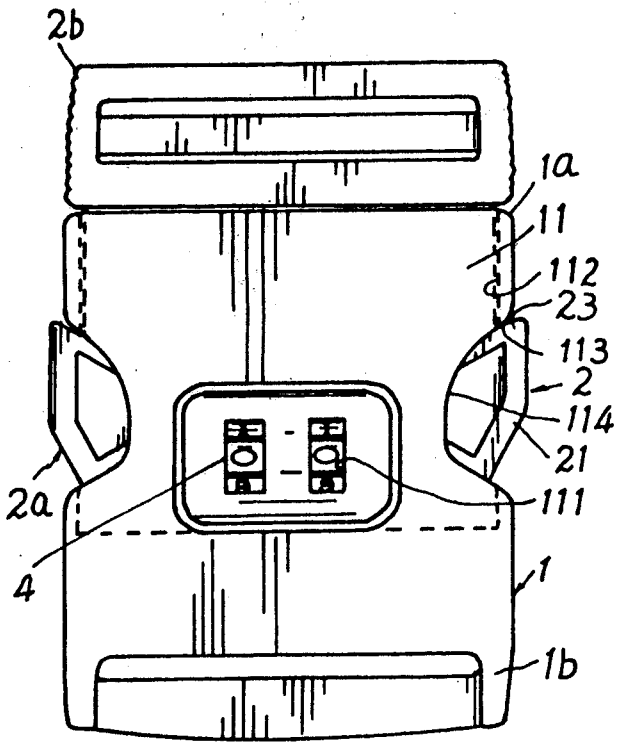
FIG. 1 is a front view illustration of the present invention.

As shown in FIGS. 1-9, the present invention comprises: a female lock body 1, a male buckle means 2, a plurality of sleeves 3, a plurality of dials 4, and a strap or belt 5.

The female lock body 1 includes: an upper cover 11, a lock base 12 combined with the upper cover 11, a pair of pivot-holding portions 13 disposed on two opposite side portions of the lock body 1 for rotatably mounting two outer pivots 31 of a pair of sleeves 3 on the pivot-holding portions 13, a pair of sleeve-holding portions 14 disposed on two opposite side portions of the lock body 1 each sleeve-holding portion 14 adjacent to each pivot-holding portion 13 and formed with a sleeve recess 141 in the sleeve-holding portion 14 for rotatably mounting a sleeve 3 on each sleeve-holding portion 14, a pair of dial grooves 15 each dial groove 15 recessed in the lock body 1 positioned inside and adjacent to each sleeve-holding portion 14 for rotatably mounting a dial 4 in the dial groove 15, an intermediate block 16 formed in a central portion of the lock body 1 having two retarding extensions 161 disposed on two opposite sides of the intermediate block 16 for limiting the sleeves 3, a central socket 10 recessed in a free end portion 1*a* of the lock body 1 for receiving a central extension 24 of the male buckle means 2, and a fixed end portion 1*b* of the lock body 1 opposite to the free end portion 1*a* secured with a first strap end portion 51 of the strap 5.

The male buckle means 2 includes: a pair of latch members 21 disposed on two outer sides of the central extension 24 of the buckle means 2 and operatively insertable in two latch passages 112 formed in two outer side portions in the female lock body 1 (FIGS. 1, 2), each latch member 21 positioned at a first end portion 2*a* of the buckle means 2 having a lug 22 protruding inwardly from the latch member 21 to be operatively retarded by the sleeve 3 for locking the latch member 21 in the lock body 1 and having a hook portion 23 formed on an outer portion of the latch member 21 to be engageably locked by a side wall stopping portion 113 adjacent to the latch passage 112, with the latch member 21 being lockable in the lock body 1 and positioned in a depression slot 114 cut out in each outer middle side portion of the lock body 1 and a second end portion 2*b* opposite to the first end portion 2*a* secured to a second strap end portion 52 of the strap 5.

Figure 3:
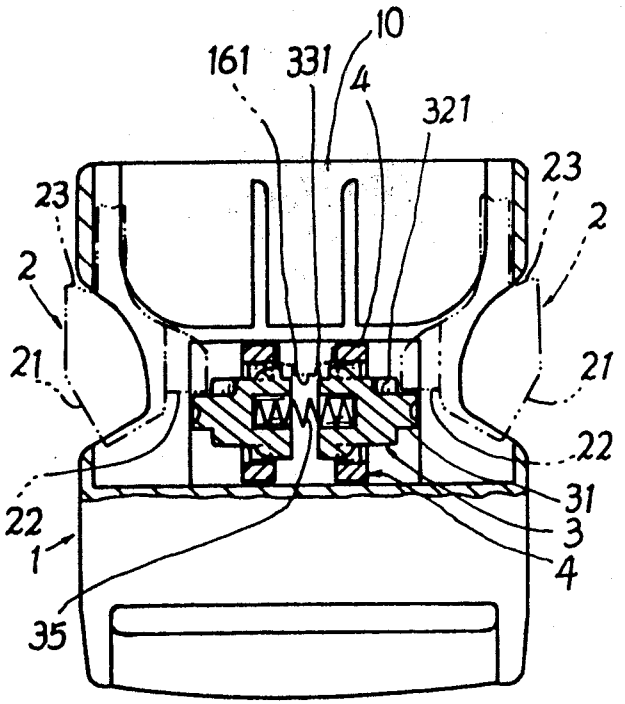
FIG. 3 is an illustration showing an engagement of a female lock body with a male buckle means.
Figure 5:
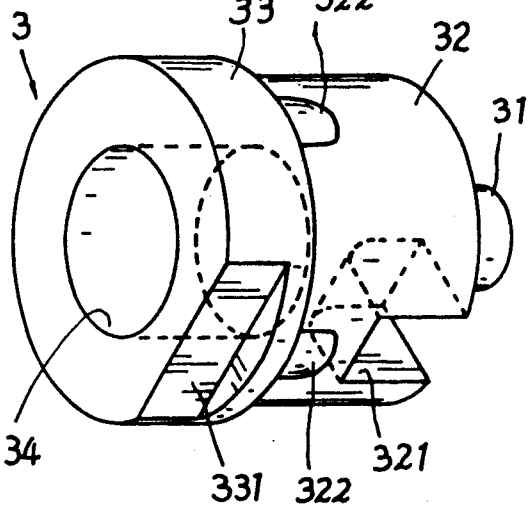
FIG. 5 is a perspective view of a sleeve of the present invention.
Figure 4:
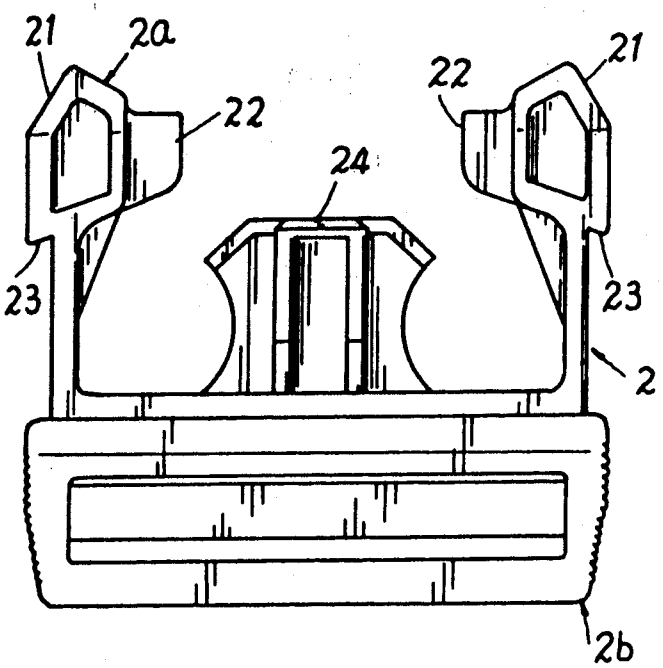
FIG. 4 is an illustration showing the male buckle means.
Figure 6:
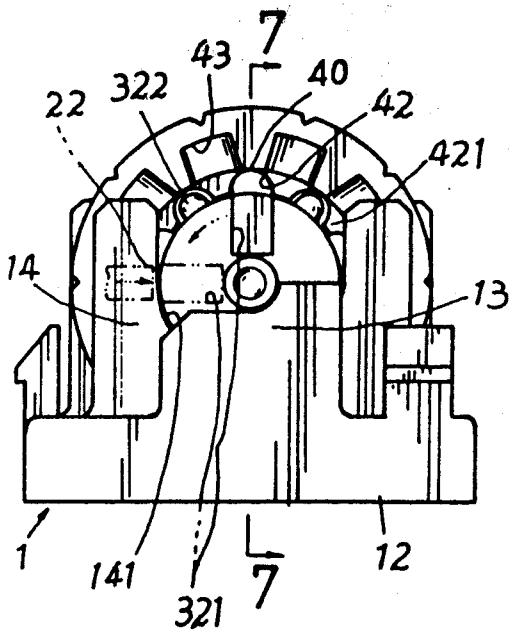
FIG. 6 is a side view illustration showing a dial coupled with a sleeve of the present invention.
Figure 9:
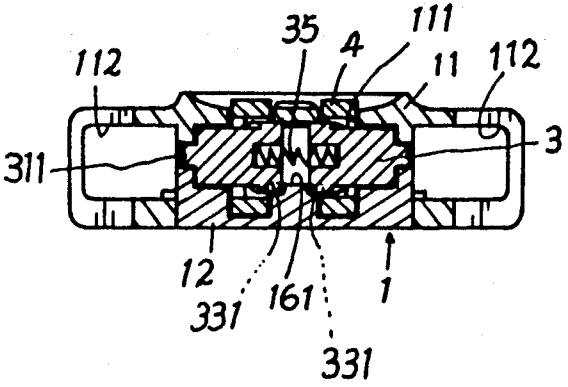
FIG. 9 is a cross sectional drawing of the present invention.

Each sleeve 3 coupled with each dial 4 includes: the outer pivot 31 protruding outwardly and rotatably mounted on the pivot-holding portion 13 of the female lock body 1 having a needle hole 311 recessed in an outer surface of the pivot 31 and correspondingly communicating the depression slot 114 of the lock body 1, an elongate cylindrical portion 32 secured to the pivot 31 rotatably engageable with the sleeve recess 14 in the body 1 having a lug slot 321 recessed in an outer portion of the elongate cylindrical portion 32 to be operatively engageable with the lug 22 of the latch member 21 allowing an inward depression of the latch member 21 for unlocking the latch member 21 from the stopping portion 113 of the lock body 1 and having a plurality of protrusions 322 annularly formed on the elongate cylindrical portion 32 engageable with a plurality of coupling recesses 42 annularly recessed in each dial 4 for coupling each sleeve 3 with each dial 4, a short cylindrical portion 33 formed on an inner portion of the sleeve 3 adjacent to the elongate cylindrical portion 32 and rotatably engageable with a central hole 40 formed in the dial 4, a secant recess portion 331 cut out in a peripheral portion ofthe short cylindrical portion 33 to be slidably engageable with the retarding extension 161 of the lock body 1, and a spring socket 34 recessed in an inner surface of the sleeve 3 opposite to the pivot 31 for inserting a tensioning spring 35 in the spring socket 34 to allow the tensioning spring 35 resiliently retained in two neighbouring sleeves 3 for normally urging the two sleeves 3 outwardly as shown in FIGS. 3, 9 for coupling each sleeve 3 with each dial 4.

Each dial 4 rotatably coupled on each sleeve 3 to protrude a peripheral portion of the dial 4 beyond a dial opening 111 formed in the upper cover 11 of the lock body 1 includes: a plurality of numerals 41 annularly formed on the dial 4, an annular shoulder portion 421 annularly formed on the central hole 40 of the dial 4 with the plurality of coupling recesses 42 annularly recessed in the annular shoulder portion 421 for engaging the protrusions 322 of the sleeve 3, and a plurality of positioning recesses 43 annularly recessed in an inner surface of the dial 4 to be rotatably resiliently urged by a positioning spring 17 fixed in the intermediate block 16 of the lock body 1 for clickingly rotatably mounting each dial 4 on the lock body 1.

When using the present invention for locking purpose, the male buckle means 2 is inserted into the socket 10 in the female lock body 1 to pass the latch members 21 through the latch passages 112 until each hook portion 23 is engaged with the stopping portion 113 formed in the lock body 1, and the dials 4 are rotated to rotate the sleeves 3 to deviate the lug slot 321 of each sleeve 3 from the lug 22 of the latch member 21 of the buckle means 2, whereby when depressing the latch member 21 inwardly trying to unbuckle the buckle means 2 from the lock body 1, the lug 22 can not be retracted into each lug slot 321 formed in the sleeve 3 and the hook portion 23 is engaged with the stopping portion 113 thereby locking the male buckle means 2 in the female lock body 1.

For unlocking the present invention, the dials 4 and the sleeves 3 are rotated to match each lug slot 321 with the lug 22 of the buckle means 2 as shown in FIG. 3, whereby upon a depression of the latch member 21 inwardly to retract the lug 22 into the socket 321 to disengage the hook portion 23 of the male buckle means 2 from the stopping portion 113 of the female lock body 1, thereby unlocking the buckle means 2 from the lock body 1.

Figure 8:
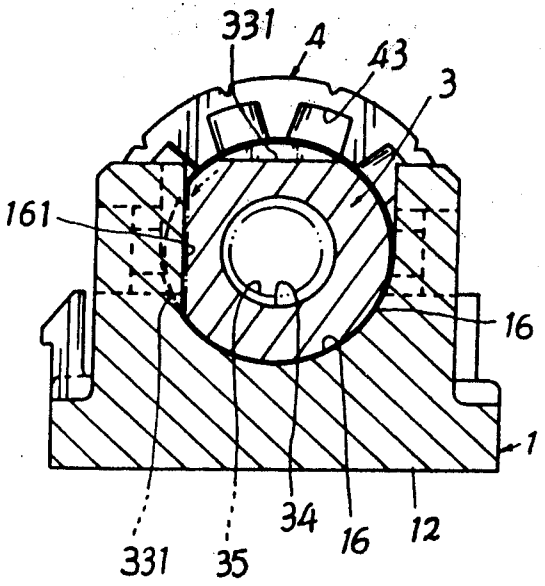
FIG. 8 is a sectional drawing of the invention when viewed from 8—8 direction of the FIG. 7.
Figure 7:
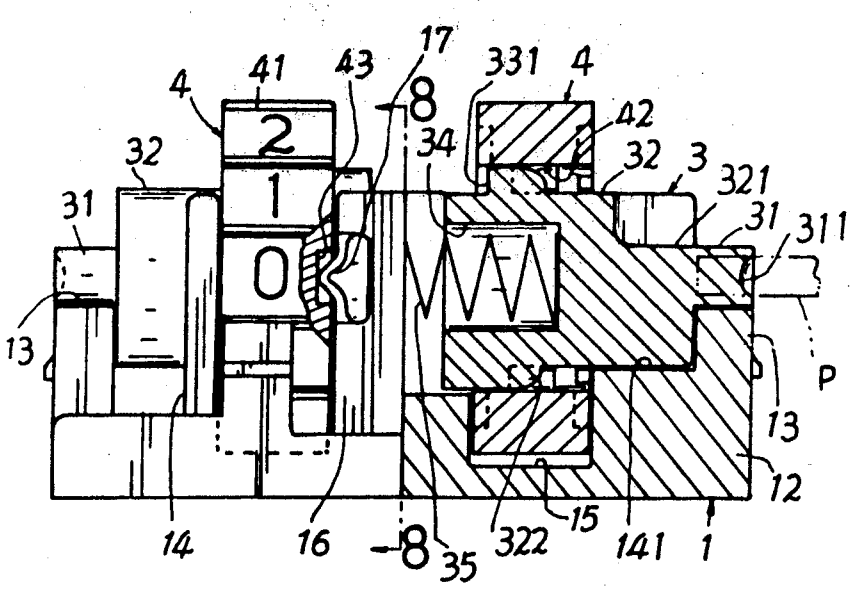
FIG. 7 is a sectional drawing of the present invention when viewed from 7—7 direction of FIG. 6.

For changing or re-setting a combination for the present invention when unlocked, a needle or needle-like article P as shown in FIG. 7 is inserted into the needle hole 311 in each sleeve 3 to depress the sleeve 3 inwardly, in which the secant recess portion 331 of the sleeve 3 has already been rotated to slidably pass the retarding extension 161, as shown in dotted line of FIG. 8 when locking the lock, to be retracted inwardly to disengage each sleeve 3 from each dial 4 for a free rotation of the dial 4 for resetting a new combination. Then, the tensioning spring 35 will urge the sleeves 3 outwardly ready for next unlocking or locking operation of the lock.

Figure 10:
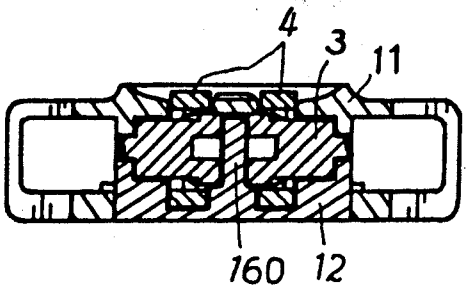
FIG. 10 is a cross sectional drawing of another preferred embodiment of the present invention.

Another preferred embodiment of the present invention is shown in FIG. 10, in which the tensioning spring 35 retained between two neighbouring sleeves 3 is omitted and an intermediate block 16 is formed with a partition plate 160 for separating the two neighbouring sleeves 3. By the way, the mechanism for changing a combination of the present invention as aforementioned is now eliminated.

I claim:

1. A combination lock of strap buckle comprising: a female lock body secured on a first end portion of a strap; a male buckle means secured on a second end portion of the strap having a pair of latch members engageable with two latch-member slots formed in said female lock body for fastening said first and said second end portions of said strap, said two latch members being depressible for disengaging from said latch member slots for unbuckling said buckle means from said lock body; and a pair of dials coupled with a pair of sleeves rotatably mounted in said female lock body; said pair of sleeves being separated by a partition plate formed in an intermediate block in said lock body, each said sleeve operatively retaining said latch member of said male buckle means in said female lock body for locking said buckle means in said lock body when said dials are rotated to a locking combination thereof, and each said sleeve having a sleeve slot recessed therein for retracting said latch member of said male buckle means therein when depressing said latch members of said buckle means thereby unbuckling and unlocking said male buckle means from said female lock body.

2. A combination lock of strap buckle comprising: a female lock body secured on a first end portion of a strap; a male buckle means secured on a second end portion of the strap engageable with said female lock body for fastening said first and said second end portions of said strap; and a plurality of dials coupled with a plurality of sleeves rotatably mounted in said female lock body; at least one said sleeve operatively retaining said male buckle means in said female lock body for locking said buckle means in said lock body when said dials are rotated to a locking combination thereof, and said sleeves having means for retracting said male buckle means when depressing said buckle means for disengaging and unlocking said male buckle means from said female lock body;

said female lock body including: an upper cover, a lock base combined with the upper cover, a pair of pivot-holding portions disposed on two opposite side portions of the lock body for rotatably mounting two outer pivots of a pair of sleeves on the pivot-holding portions, a pair of sleeve-holding portions disposed on two opposite side portions of the lock body, each said sleeve-holding portion adjacent to each said pivot-holding portion and formed with a sleeve recess in the sleeve-holding portion for rotatably mounting one said sleeve on each said sleeve-holding portion, a pair of dial grooves, each dial groove recessed in the lock body positioned inside and adjacent to each said sleeve-holding portion for rotatably mounting one said dial in the dial groove, an intermediate block formed in a central portion of the lock body having two retarding extensions disposed on two opposite sides of the intermediate block for limiting the sleeves, a central socket recessed in a free end portion of the lock body for receiving a central extension of the male buckle means, and a fixed end portion of the lock body opposite to the free end portion secured with said first strap end portion of the strap; and said male buckle means including: a pair of latch members disposed on two outer sides of the central extension of the buckle means and operatively insertable in two latch passages formed in two outer side portions of the female lock body, each said latch member positioned at a first end portion of the buckle means having a lug protruding inwardly from the latch member to be operatively retarded by a sleeve for locking the latch member in the lock body and having a hook portion formed on an outer portion of the latch member to be engageably locked by a side wall stopping portion adjacent to the latch passage, with the latch member being lockable in the lock body and positioned in a depression slot cut out in each outer middle side portion of the lock body and a second end portion of said male buckle means opposite to the first end portion of said buckle means secured to a second strap end portion of the strap.

3. A combination lock of strap buckle according to claim 2, wherein each said sleeve coupled with each said dial includes: the outer pivot protruding outwardly and rotatably mounted on the pivot-holding portion of the female lock body having a needle hole recessed in an outer surface of the pivot and correspondingly communicating the depression slot of the lock body, an elongate cylindrical portion secured to the pivot rotatably engageable with the sleeve recess in the lock body having a lug slot recessed in an outer portion of the elongate cylindrical portion to be operatively engageable with the lug of the latch member allowing an inward depression of the latch member for unlocking the latch member from the stopping portion of the lock body and having a plurality of protrusions annularly formed on the elongate cylindrical portion engageable with a plurality of coupling recesses annularly recessed in each said dial for coupling each said sleeve with each said dial, a short cylindrical portion formed on an inner portion of the sleeve adjacent to the elongate cylindrical portion and rotatably engageable with a central hole formed in the dial, a secant recess portion cut out in a peripheral portion of the short cylindrical portion to be slidably engageable with a retarding extension of the lock body, and a spring socket recessed in an inner surface of the sleeve opposite to the pivot for inserting a tensioning spring in the spring socket to allow the tensioning spring resiliently retained in two neighbouring sleeves for normally urging the two sleeves outwardly for coupling each said sleeve with each said dial.

4. A combination lock of strap buckle according to claim 3, wherein each said dial is rotatably coupled on each said sleeve to protrude a peripheral portion of the dial beyond a dial opening formed in the upper cover of the lock body and includes: a plurality of numerals annularly formed on the dial, an annular shoulder portion annularly formed on a central hole of the dial with the plurality of coupling recesses annularly recessed in the annular shoulder portion for engaging the protrusions of the sleeve, and a plurality of positioning recesses annularly recessed in an inner surface of the dial to be rotatably resiliently urged by a positioning spring fixed in the intermediate block of the lock body for clickingly rotatably mounting each said dial on the lock body.

* * * * *